US006246938B1

(12) United States Patent
Giletta et al.

(10) Patent No.: US 6,246,938 B1
(45) **Date of Patent: *Jun. 12, 2001**

(54) VEHICLE FOR SPREADING PRODUCTS ON THE ROAD SURFACE, IN PARTICULAR DE-ICING PRODUCTS

(75) Inventors: Enzo Giletta; Guido Giletta, both of Revello (IT)

(73) Assignee: Giesecke & Devrient GmbH, Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 143 days.

(21) Appl. No.: 08/948,457

(22) Filed: Oct. 10, 1997

(30) Foreign Application Priority Data

Oct. 11, 1996 (IT) ..... TO96A0832

(51) Int. Cl.[7] ..... E01H 10/00; G01C 21/00
(52) U.S. Cl. ..... 701/50; 701/213; 342/357.17
(58) Field of Search ..... 701/213, 50; 342/457, 342/357.13, 357.17

(56) References Cited

U.S. PATENT DOCUMENTS

| | | | | |
|---|---|---|---|---|
| 5,220,876 | * | 6/1993 | Monson et al. | 111/130 |
| 5,754,137 | * | 5/1998 | Durrstein | 342/357 |
| 5,757,640 | * | 5/1998 | Monson | 364/131 |
| 5,774,070 | * | 6/1998 | Rendon | 340/905 |
| 5,801,948 | * | 9/1998 | Wood et al. | 364/468.15 |

FOREIGN PATENT DOCUMENTS

| | | |
|---|---|---|
| 39 38 147 | 6/1991 | (DE) . |
| 0 576 121 | 12/1993 | (EP) . |
| 8 800 868 | 11/1989 | (NL) . |
| 97 13926 | 4/1997 | (WO) . |

* cited by examiner

*Primary Examiner*—Michael J. Zanelli
(74) *Attorney, Agent, or Firm*—Reed Smith Hazel & Thomas LLP

(57) ABSTRACT

The vehicle is provided with a GPS receiver cooperating with a satellite positioning system in order to determine the position of the vehicle and subsequently to control, on the basis of the position detected, a distribution device, by adjusting the quantity of product distributed and its spreading methods as a function of the positions of the vehicle along a road route in order to adapt the spreading parameters to the morphological condition of the route.

6 Claims, 4 Drawing Sheets

VEHICLE FOR SPREADING PRODUCTS ON THE ROAD SURFACE, IN PARTICULAR DE-ICING PRODUCTS

BACKGROUND OF THE INVENTION

The present invention relates to a vehicle for spreading products on the road surface, in particular de-icing or abrasive products.

Vehicles adapted to spread, on the asphalt layer covering the roadbed, abrasive products adapted to improve the roadholding properties of the road surface and/or de-icing products adapted to prevent (or remove) ice formation and deposits of snow on this road surface are known. The first category of vehicles includes vehicles adapted to spread on the road surface granular abrasive products (such as gravel or sand) adapted to be incorporated into the layer of ice possibly covering the road surface in order to improve its roadholding properties. The second category of vehicles includes vehicles adapted to spread on the road surface de-icing products (such as chlorides, salt grains, saline or melting solutions in general) adapted to prevent (or remove) ice formation and/or deposits of snow on the road surface.

Vehicles of the above type whose operation is controlled by electronic control devices adapted to control the spreading parameters of the products (for instance the quantity of product spread per square meter, the width and symmetry of spreading, etc.) in a predetermined way are in particular known.

These known electronic control devices in particular comprise a memory containing a plurality of spreading parameters grouped in programs, each of which is adapted to a particular morphological condition of the route and/or to a particular meteorological condition, a keyboard disposed within the vehicle for the selection of the program most adapted to the route being travelled by the vehicle, and a processing unit adapted to read from the memory the spreading parameters relating to the program selected in order to determine and actuate the quantity of product distributed and its distribution methods.

At present, however, once the product spreading program that is in keeping with the meteorological condition and the morphological condition of the route has been selected, the relative parameters are actuated irrespective of variations in the actual morphological conditions of the route and therefore, if these conditions vary, the spreading parameters are no longer optimum and have to be adjusted manually by the vehicle operator who has to assess the specific situation and act accordingly on the spreading parameters.

There may, for instance, be variations in the morphological conditions of the route when the vehicle approaches a junction, a viaduct or a square, etc., at the location of which it is normally necessary to vary the product spreading parameters. The morphological conditions of the route may also vary when the width of the carriageway varies.

It has therefore been felt necessary to provide vehicles equipped with devices for controlling spreading operations that are able automatically to act on the spreading parameters if there is any variation in the morphological conditions of the route on which spreading is taking place and also to avoid errors caused by difficult operating conditions and/or operator errors.

SUMMARY OF THE INVENTION

The object of the present invention is to provide a vehicle for spreading products on the road surface, in particular de-icing or abrasive products, which makes it possible simply and economically to adjust the values of the product spreading parameters to variations in the morphological conditions of the route along which the vehicle is travelling. The object of the present invention is also to provide a method for spreading products on the road surface, in particular de-icing or abrasive products, which makes it possible automatically to modify the spreading parameters during the route along which the vehicle is travelling.

The present invention relates to a vehicle for spreading products on the road surface, in particular de-icing or abrasive products, as described in claim 1. The present invention also relates to a method for spreading products on the road surface, in particular de-icing or abrasive products.

BRIEF DESCRIPTION OF THE DRAWINGS

For an improved understanding of the invention, a preferred embodiment is described below, purely by way of non-limiting example, with reference to the accompanying drawings, in which.

DETAILED DESCRIPTION OF THE INVENTION

Figure 1:
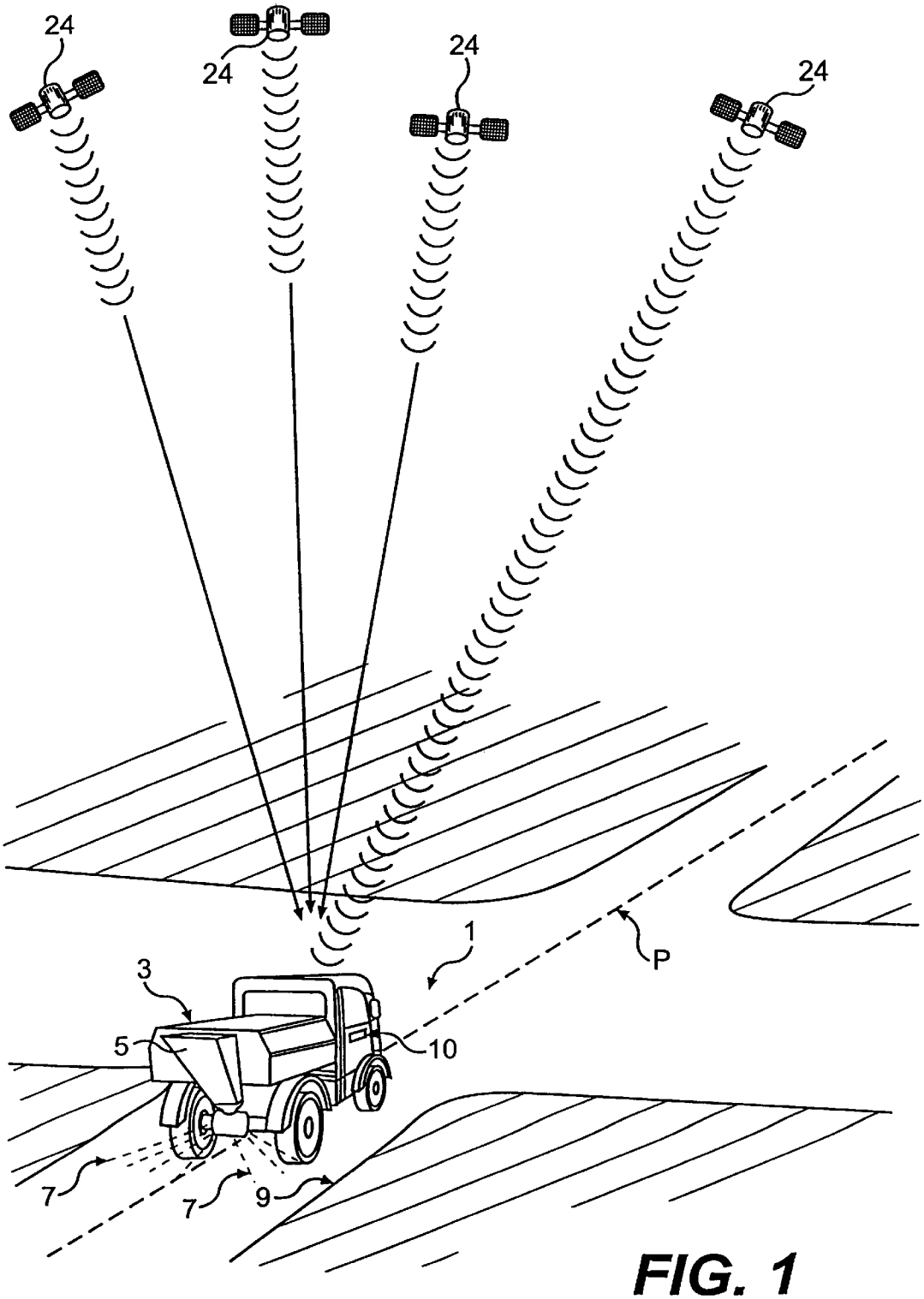
FIG. 1 diagrammatically illustrates a vehicle for spreading products on the road surface, in particular de-icing or abrasive products.

A vehicle, in particular an industrial vehicle, is shown overall by 1 in FIG. 1 and comprises a tank 3 adapted to contain a (liquid or solid) product 7 for the treatment of the road surface and a distribution device 5 preferably mounted on the rear portion of the vehicle 1 and adapted to spread the product 7 on the road surface 9 of a road route P along which the vehicle 1 is travelling. In the embodiment illustrated, the vehicle 1 is in particular adapted to distribute de-icing products and is provided with a distribution device 5 of centrifugal type adapted to spread granular salt. The following description will therefore refer to the above-mentioned embodiment, while it is understood that the vehicle 1 may spread other products on the road surface, for instance granular abrasive products (such as gravel or sand) or de-icing products of a liquid type (for instance saline or melting solutions in general) adapted to prevent (or remove) ice formation and/or deposits of snow on the road surface.

The vehicle 1 is also provided with an electronic control device 10 (shown diagrammatically) adapted to control the distribution device 5 in order to adjust in a known manner the quantity of product distributed and the distribution methods as a function of a plurality of spreading parameters.

Figure 2:
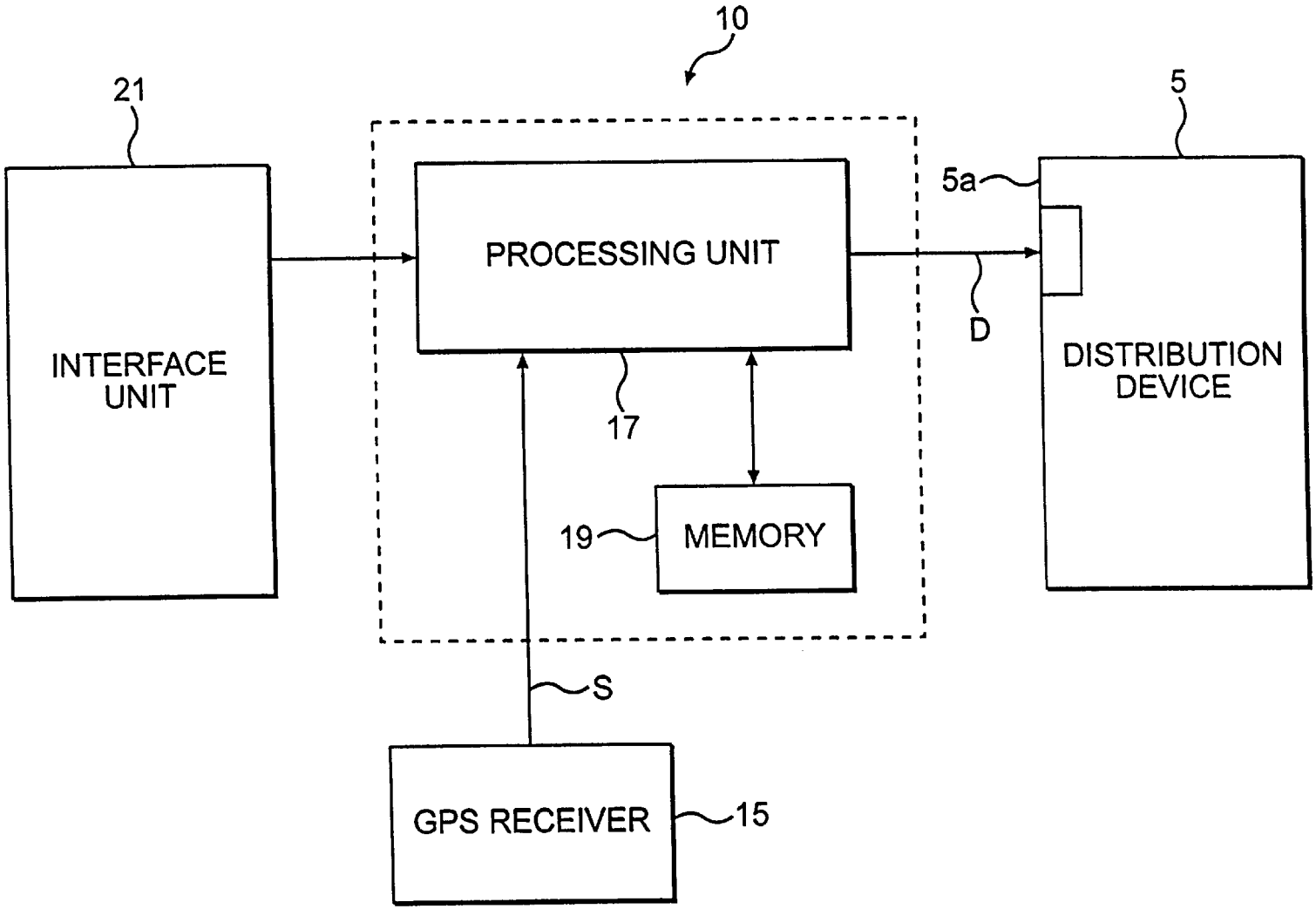
FIG. 2 is a block diagram of a device for controlling the product spreading operations of the vehicle of FIG. 1.

In FIG. 2, the electronic control device 10 comprises a GPS receiver 15 adapted to generate as output a signal S correlated to the position and direction of movement of the vehicle 1, a processing unit 17 cooperating with the GPS receiver 15 and a memory 19 communicating with the processing unit 17. The device 10 further comprises an interface unit 21 communicating with the processing unit 17 and adapted to be used by an operator (not shown) located within the cabin of the vehicle 1 in order to control the salt spreading operations. The interface unit 21 may also be integrated with the processing unit 17.

The processing unit 17 is adapted to supply control signals D to an interface 5*a* of the distribution device 5 in order to control, in a known manner, the quantity of salt distributed and the spreading methods. By means of the control signals D it is possible, for instance, to adjust (in a known manner) the quantity of salt distributed per square meter, the spreading width, the spreading symmetry (lateral, central) and the percentage humidity of the salt spread.

The GPS receiver 15 cooperates with a GPS satellite positioning system for the detection of the absolute position of the vehicle 1 on the earth's surface. As is known, the GPS positioning system comprises a plurality of satellites 24 (FIG. 1) disposed in orbit about the earth, distributed on six different orbital planes and adapted to generate radio signals that are picked up by the receiver 15 for the detection of the position of this receiver with an error of less than one hundred meters. In the GPS system, the receiver 15 in particular determines its own absolute position by locating its own distance with respect to at least four satellites and carrying out, on the basis of the distances detected, a calculation based on a geometric triangulation.

The invention is based on the use of the GPS (Global Positioning System) satellite positioning system in order to determine the position and direction of the vehicle and thus to control, on the basis of the position detected (as described in detail below), the distribution device 5 by adjusting the quantity of product distributed and its spreading methods as a function of the position of the vehicle in order to modify the spreading methods as a function of the morphological condition of the route.

In particular, all the spreading parameters relating to a respective route that can be travelled by the vehicle define a salt spreading method which is adapted to a particular morphological condition of the route and/or to a particular meteorological condition. A salt spreading method may, for instance, be defined by four spreading parameters such as:

parameter p1: quantity of salt spread per square meter;

parameter p2: spreading width;

parameter p3: spreading symmetry (lateral, central);

parameter p4: humidification present or absent and, if present, percentage humidification of the salt spread.

The data representative of these spreading methods are stored in the memory 19 and can normally be recalled by the operator via the interface unit 21 at the beginning of the relative route in order to generate the control signal for the distribution device. According to the present invention, the different salt spreading methods are selected automatically on the basis of the position of the vehicle along the road route detected by the GPS receiver.

In operation, the memory of the control device 10 is programmed "in the field" by means of a so-called self-learning operation or by travelling each of the routes on which salt spreading operations need to be carried out for the first time and memorising the spreading parameters for each route associated with the relative position in which they are to be actuated, as described in detail below with reference to FIG. 3.

The operation of the control device will now be described in detail with reference to the flow charts shown in FIGS. 3 and 4 which relate to the stages of programming the memory with the values of the salt spreading parameters as a function of the position of the vehicle and the stages of use of these data for the management of the salt spreading operations.

Figure 3:
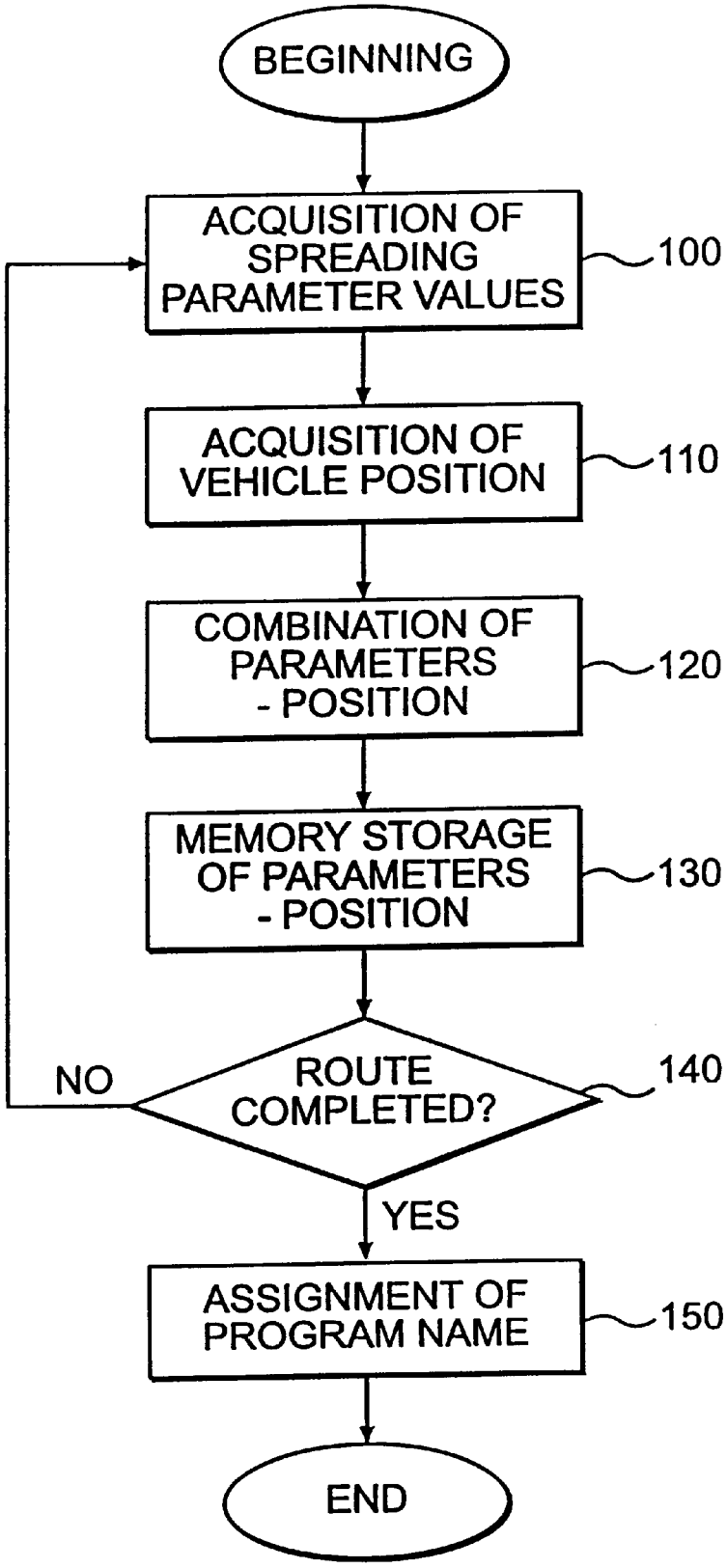
FIG. 3 is a flow chart relating to a first sequence of operations carried out by the device of FIG. 2.

As shown in FIG. 3, relating to the programming of the values of the salt spreading parameters for a single route travelled by the vehicle, a block 100 is initially reached in which the processing unit 17 acquires a value for each of the spreading parameters p1–p4. These values are input manually by the operator via the interface 21 thereby defining a predetermined spreading method.

The block 100 is followed by a block 110, in which the processing unit acquires the position and direction signal S generated by the GPS receiver 15.

The block 110 is followed by a block 120 in which the processing unit combines the values of the spreading parameters p1–p4 input by the operator with the position and direction signal S thereby determining an unequivocal association between the spreading parameters and the location at which these are to be actuated during the subsequent salt spreading operations.

The block 120 is followed by a block 130, in which the processing unit 17 stores these parameters p1–p4 and the relative positions associated therewith in the memory 19.

The block 130 is followed by a block 140 in which the processing unit 17 checks whether the route on which these parameter acquisition operations are taking place has come to an end; this check may, for instance, be carried out by acquiring the condition of a stop signal input by the operator via the interface unit 21.

If the route has come to an end (YES output from the block 140), a block 150 is reached, otherwise (NO output from the block 140) there is a return to the block 100 into which new salt spreading parameters p1–p4 are input. Following the inputting of these new parameters, the block 100 is followed by the blocks 110, 120 in which these new parameters are associated with respective further positions reached by the vehicle along the route. In this way, at the end of the route a plurality of groups of spreading parameters, defining respective spreading methods, associated with successive and adjacent positions of the road route travelled by the vehicle during the self-learning stage, are stored in the memory 19.

In the block 150, which is reached at the end of the route travelled by the vehicle, the processing unit 17 terminates the spreading parameter acquisition operation, thereby obtaining a series of data which represent a genuine program for the processing unit; an identification name is also given to this program which is stored in the memory 19. The program can then be recalled via the interface unit 21 when the route to which it relates is to be travelled by the vehicle 1 in order to carry out salt spreading operations.

All the operations described above may then be repeated for other routes travelled by the vehicle, thereby obtaining a series of different programs each relating to a route and which can subsequently be recalled via the interface unit during salt spreading operations.

At the end of the operations to acquire the values of the parameters and the positions associated therewith, it is possible to carry out a series of operations which make it possible to obtain further programs.

The values of the spreading parameters of each program can in particular be modified, via a personal computer, to create other programs still relating to the same route but useful in different environmental conditions, without having to repeat the parameter acquisition procedure.

The values of the parameters of a program can, for instance, be modified for each route in order to adapt them to different intensities of snow, different temperature and hygrometric conditions, etc., thereby obtaining a different program that is given a different identification name; it is possible in particular to obtain a program which allows useful spreading of salt before snow (preventive treatment) or a program that allows a type of spreading useful during snow (curative treatment) and so on.

The programs obtained at the acquisition stage can, moreover, again by means of personal computer, be stored in a plurality of memories which are than mounted on respective salt-spreading vehicles, making it unnecessary for each of these to travel the routes on which the salt spreading operations are to be carried out.

Figure 4:
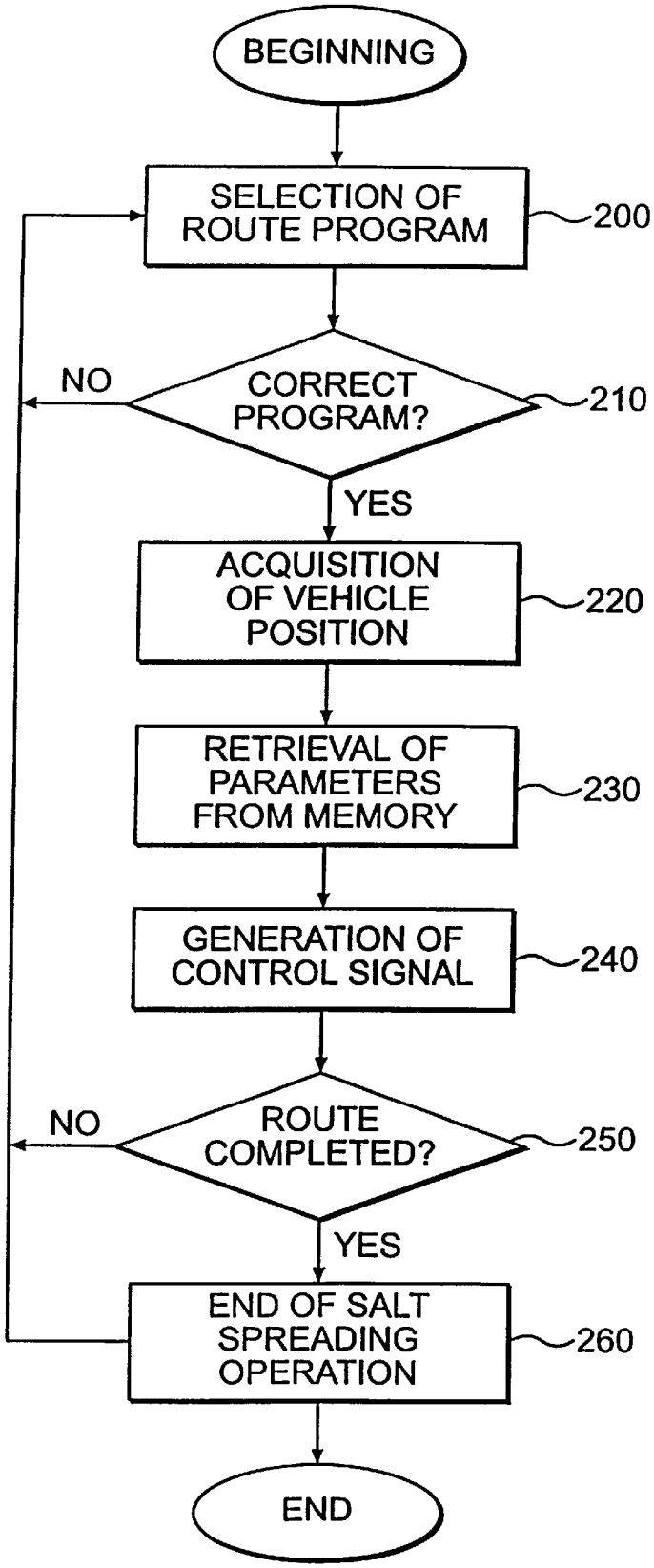
FIG. 4 is a flow chart relating to a second sequence of operations carried out by the device of FIG. 2.

FIG. 4 shows a flow chart relating to the operations carried out by the control device 10 during a salt spreading operation along any one of the routes.

In particular, a block 200 is initially reached, in which the operator selects the program that needs to be run for this route via the interface unit 21.

The block 200 is followed by the block 210, in which the processing unit checks whether the program selected relates in terms of position and direction to the actual position and direction of the vehicle.

If the program does not relate to that route (NO output from the block 210), the processing unit indicates that it is impossible to run the program selected and the operations restart from the block 200, otherwise (YES output from the block 210) the block 220 is reached, in which the processing unit, after loading the selected program, acquires the position and direction signal S supplied at that time by the GPS receiver 15.

The block 220 is followed by a block 230 in which the processing unit 10 detects the values of the salt spreading parameters p1–p4 associated with the position currently reached, i.e. which salt spreading method p1–p4 is provided for this position. In this way, a precise salt spreading method corresponds to each position detected.

The block 230 is followed by a block 240, in which the processing unit 17 retrieves the salt spreading parameters selected in the block 230 from the memory and then generates a control signal for the distribution device 5; this control signal is correlated with the spreading parameter values detected.

The block 240 is followed by a block 250 in which the processing unit 17 checks whether the route on which the salt spreading operations are taking place has come to an end; this check may, for instance, be carried out by acquiring the condition of a stop signal input by the operator via the keyboard.

If the route has come to an end (YES output from the block 240), this is followed by a block 250 in which the processing unit terminates the salt spreading operations, otherwise (NO output from the block 230), there is a return to the block 200 and the operations described with reference to the blocks 200–240 are repeated. For successive different positions of the route, different salt spreading parameters are in particular retrieved and actuated thereby modifying the salt spreading methods along the route in a fully automatic way.

It is lastly evident that variations and modifications may be made to the vehicle for treating road surfaces with granular or liquid products described and illustrated above without thereby departing from the protective scope of the present invention.

For instance, the position and direction of the vehicle may be determined using other positioning systems, possibly of a local type, and not necessarily solely using the GPS satellite positioning system.

Moreover, the programs relating to each route may also be generated without travelling all the routes for a first time, but simply by directly editing each method on a personal computer and storing it in the memory.

What is claimed is:

1. A vehicle for spreading at least one de-icing product on a road surface comprising:

distribution means borne by the vehicle and adapted to spread said product on the road surface;

electronic control means operatively connected to said distribution means for controlling the spreading of said product by said distribution means in response to operating parameters including a quantity operating parameter, a spreading width parameter, a spreading symmetry parameter and a humidification parameter of the de-icing product, wherein the electronic control means includes positioning means for generating a position signal correlated with the position of said vehicle, and the electronic control means cooperating with said positioning means in order to associate values of said operating parameters with each position of the vehicle detected along a route; and self-learning means for generating a plurality of values for each operating parameter, each of said values being associated with a position detected along the route which the vehicle is traveling, wherein the self-learning means includes:

means for manually inputting said values of operating parameters;

detection means for acquiring a position signal generated by the position generating means;

means for correlating the inputted values of said operating parameters with said position signal;

memory storage means for storing said operating parameters and a position signal associated therewith in a memory; and means for cyclical selection of said inputting means, detection means and correlation means adapted to process a plurality of values of said operating parameters in connection with respective positions of a road route traveled by the vehicle.

2. A vehicle as claimed in claim 1, wherein said positioning means includes a GPS receiver for receiving remotely transmitted navigation signals.

3. A vehicle as claimed in claim 1, wherein the at least one operating parameter is correlated with a quantity of said de-icing product distributed per unit area.

4. A method for spreading at least one de-icing product on a road surface, said method comprising the steps of:

providing a distribution means borne by a vehicle for spreading said product on the road surface;

electronically controlling the spreading of said product by said distribution means in response to operating parameters including a quantity operating parameter, a spreading width parameter, a spreading symmetry parameter and a humidification parameter of the de-icing product, wherein said step of controlling the spreading includes:

receiving a position signal correlated with the position of said vehicle, and associating said values of the operating parameters with each position of the vehicle detected along a route; and generating on a self-learning basis said values of the operating parameters, each of said values being associated with a position detected along the route which the vehicle is traveling, wherein said self-learning generation step includes:

manually inputting said values of operating parameters;

acquiring a position signal generated by the position generating means;

correlating said values of operating parameters with said position signal;

storing said operating parameters and said position signal associated therewith in a memory; and cyclically selecting among said inputting, detecting and correlating steps so as to process said values of operating parameters in connection with respective positions of a road route traveled by the vehicle.

5. A method as claimed in claim 4, wherein said positioning steps includes a GPS receiver for receiving remotely transmitted navigation signals.

6. A vehicle as claimed in claim 4, wherein the at least one operating parameter is correlated with a quantity of said de-icing product distributed per unit area.

* * * * *

UNITED STATES PATENT AND TRADEMARK OFFICE

CERTIFICATE OF CORRECTION

PATENT NO. : 6,246,938 B1
DATED : June 12, 2001
INVENTOR(S) : Giletta et al.

It is certified that error appears in the above-identified patent and that said Letters Patent is hereby corrected as shown below:

Title page,
Item [73], Assignee, delete "Giesecke & Devrient GmbH, Munich (DE)" and add -- Giletta Michele S.p.A., 12036 Revello (Italy) --.

Signed and Sealed this

Thirtieth Day of April, 2002

*Attest:*

*Attesting Officer*

JAMES E. ROGAN
*Director of the United States Patent and Trademark Office*